United States Patent [19]

Steinhilber

[11] 4,130,249

[45] Dec. 19, 1978

[54] WIRE SPOOLER

[75] Inventor: Wilhelm A. Steinhilber, Guilford, Conn.

[73] Assignee: Orion Machinery & Engineering Corp., Branford, Conn.

[21] Appl. No.: 856,799

[22] Filed: Dec. 1, 1977

[51] Int. Cl.[2] ..... B65H 54/12; B65H 54/32

[52] U.S. Cl. ..... 242/25 R; 242/16; 242/158.2; 242/158.4 R

[58] Field of Search ..... 242/25 R, 16, 17, 26.1, 242/26.2, 26.3, 43.1, 158 R, 158 B, 158 F, 158.2, 158.4 R

[56] References Cited

U.S. PATENT DOCUMENTS

| | | | |
|---|---|---|---|
| 2,254,221 | 9/1941 | Hubbard | 242/25 R |
| 2,292,725 | 8/1942 | Treckman | 242/43.1 |
| 3,011,730 | 12/1961 | Martino | 242/25 R |
| 3,170,650 | 2/1965 | Bauer | 242/25 R |
| 3,413,834 | 12/1968 | Kovaleski | 242/25 R X |
| 3,445,073 | 5/1969 | Schippers et al. | 242/26.3 |
| 3,845,913 | 11/1974 | Hagen | 242/25 R |
| 3,876,166 | 4/1975 | Kadokura et al. | 242/158.2 |
| 4,055,312 | 10/197[illegible] | | |

*Primary Examiner*-

*Attorney, Agent, or Firm*—McCormick, Paulding & Huber

[57] ABSTRACT

The disclosed wire spooler is adapted for use in winding wire onto a spool and may be used with various kinds of spools, including the type having at least one tapered end flange, so that the traversing guide, which guides the wire onto the spool during the winding, has to move with strokes of increasing length as the spool fills with wire. The necessary increases in the traversing guide strokes are brought about by a means establishing end limits at each of which the direction of movement of the traversing guide is reversed, and by a means for widening such end limits as the total rotation of the spool increases. A pulse generator and a pair of interconnected units, each including a counter, a reference number store and a comparator, operating on a reversing mechanism, are specifically disclosed as the spool rotation measuring means, the end limit establishing means and end limit widening means. The spooler also allows the winding of a given length of wire into a groove adjacent the outboard end of a tapered flange of the spool at the start of the winding process to provide access to the starting portion of the wire after the spool is fully wound.

Figures

Fig. 1

WIRE SPOOLER

BACKGROUND OF THE INVENTION

This invention elates to a mechanism for winding wire onto spools and having a traversing guide for guiding the wire onto the spools so that the wire is wound in relatively neat layers, and deals more particularly with such a mechanism capable of being used with spools of the type having two flanges, at least one of which is tapered, and a cylindrical portion of uniform diameter between the two flanges.

In the art of spooling wire, it is well known to rotate the spool so as to draw the wire thereon and to guide the wire onto the spool by a traversing guide which engages the wire and moves back and forth between the flanges of the spool to load the wire onto the spool in an orderly fashion. In many cases, the flanges of the spool have straight faces facing one another so that the stroke of the traversing guide may remain the same throughout the full duration of the winding process. However, in some other cases the spool has one or two tapered flanges requiring that the stroke of the traversing guide increase as the spool fills with wire. U.S. Pat. Nos. 3,170,650 and 3,413,834, for example, show two prior mechanisms for winding spools with tapered flanges and which mechanisms include devices for increasing the stroke of the traversing guide as the spool being wound fills with wire.

The general object of this invention is to provide a wire spooler for winding wire onto tapered spools which spooler is an improvement over prior art devices, such as those shown by the aforementioned patents, intended for the same purpose.

A more particular object of the invention is to provide a spooler for winding wire onto tapered flange spools which spooler is of relatively simple construction and which, particularly in regard to the means for moving its traversing guide, is of a simple reliable construction comprised of relatively few moving parts.

Another object of the invention is to provide a spooler of the foregoing character which is extremely versatile insofar as being able to accommodate various different spool sizes and configurations and various different gauges of wire and spooling speeds. In keeping with this object, a further object is to provide a spooler which may be changed from one spool configuration to another and/or from one wire type or gauge to another quickly and easily and without the need for interchanging parts.

A still further object of the invention is to provide a spooling mechanism of the foregoing character and including a means enabling the spool to be wound in such a manner as to provide access to the starting portion of the wire after the spool is fully wound. This feature is of value when the spool is later used to supply wire to a production machine as the wire of the spool currently feeding the machine may be connected to the wire of the next spool, as by welding, so that when the current spool is emptied, the feed is transferred immediately to the next spool without need for stopping the production machine.

Other objects and advantages of the invention will be apparent from the following description and from the accompanying drawings forming a part thereof.

SUMMARY OF THE INVENTION

This invention concerns an apparatus for winding wire onto spools of various kinds, including the type having at least one tapered end flange, and resides in the apparatus including a means for rotating the spool about its central axis, a traversing guide movable back and forth along a path parallel to the central spool axis for guiding the wire onto the spool, and a means for widening the limits of the traversing movement of the guide in response to increases in the total rotation of the spool during the winding of the wire onto it.

More specifically, the invention resides in the means for widening the limits of the travel of the traversing guide including a means, such as a pulse generator, for producing a series of signals each representing an increment of angular movement of the spool, a counter for counting such signals and for reversing the direction of movement of the traversing guide when the count reaches a predetermined number, and other means for increasing such predetermined number each time the movement of said traversing guide undergoes a given number of reversals.

The invention also resides in the spooling mechanism including a means for moving the traversing guide into alignment with a groove at one end of the spool at the start of the winding process, to wind a given amount of wire into the groove, and for thereafter shifting the traversing guide into alignment with the adjacent end of the cylindrical portion of the spool to begin the winding routine which is thereafter carried out until the spool is filled.

DESCRIPTION OF THE PREFERRED EMBODIMENT

Figure 1:
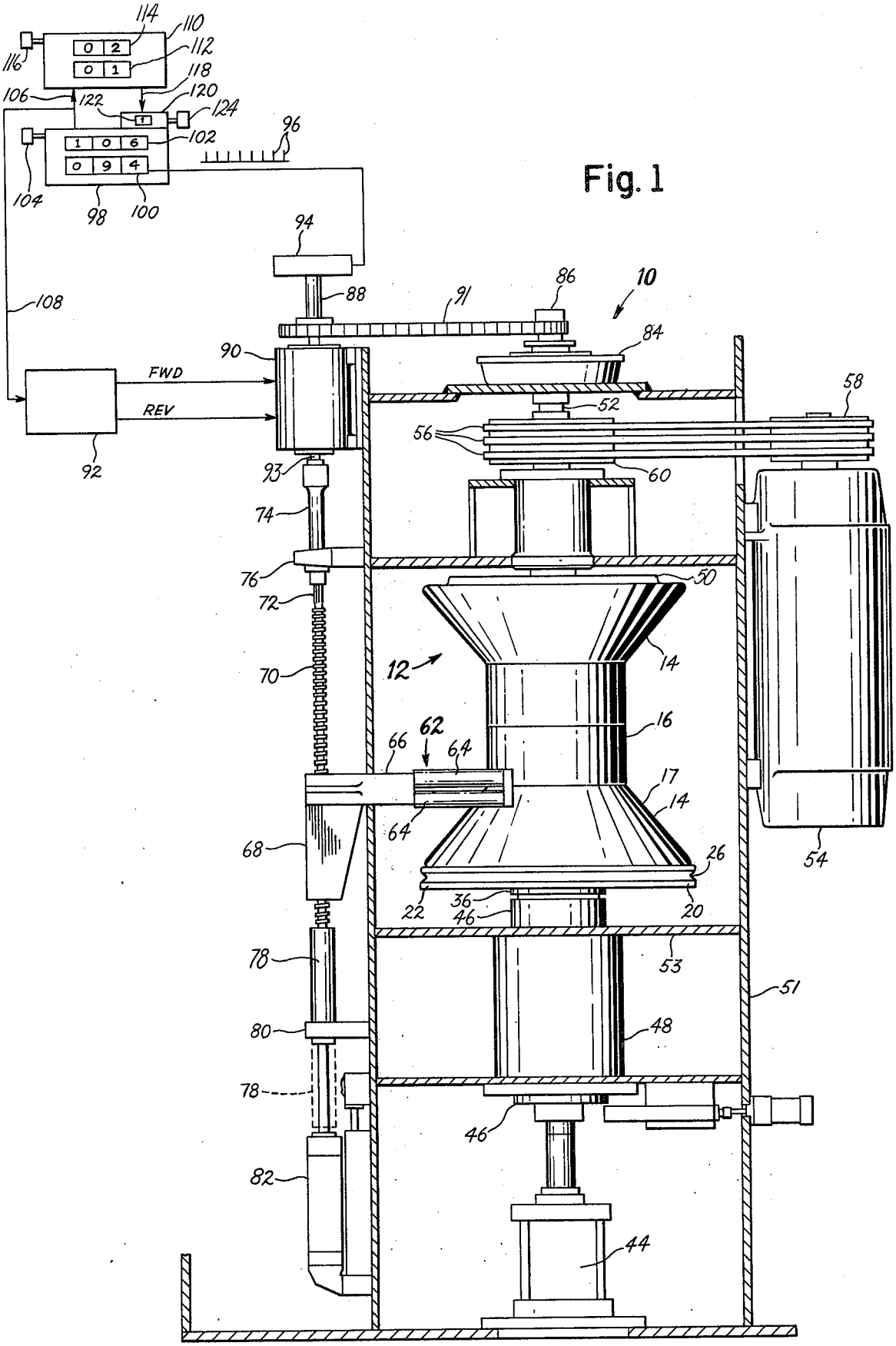
FIG. 1 is a view partly in side elevation and partly schematic of a wire spooler embodying this invention.

Turning to the drawings, a wire spooler, indicated generally at 10 in FIG. 1, is shown in association with an empty spool 12.

The spool 12 has two tapered end flanges 14, 14 and a cylindrical mid-portion 16 of uniform outside diameter. As shown best in FIG. 2, the spool is comprised of a body 17 made of two identical half sections 18, 18 of sheet metal joined to one another, as by welding, and a base 20. The base 20 includes a circular bottom plate 22, located below the bottom flange 14, and a nose ring 24 which fits inside of and supports the bottom flange 14, the bottom plate 22 having a circumferential groove 26. Fixed to the base 20 is an upright post 28 having two arms (only one of which is shown and indicated at 30 in FIG. 2) between which a transverse rod 32 extends to provide a means for attaching a hook and cable or other lifting device, entered through the top open end of the spool, to the spool for lifting it in the process of transporting if from one place to another. The spool body 17 and the base 20 normally remain with one another to make up the complete spool 12, and the spool is normally maintained in its illustrated position so that the boby of the spool rests on the base.

Figure 2:
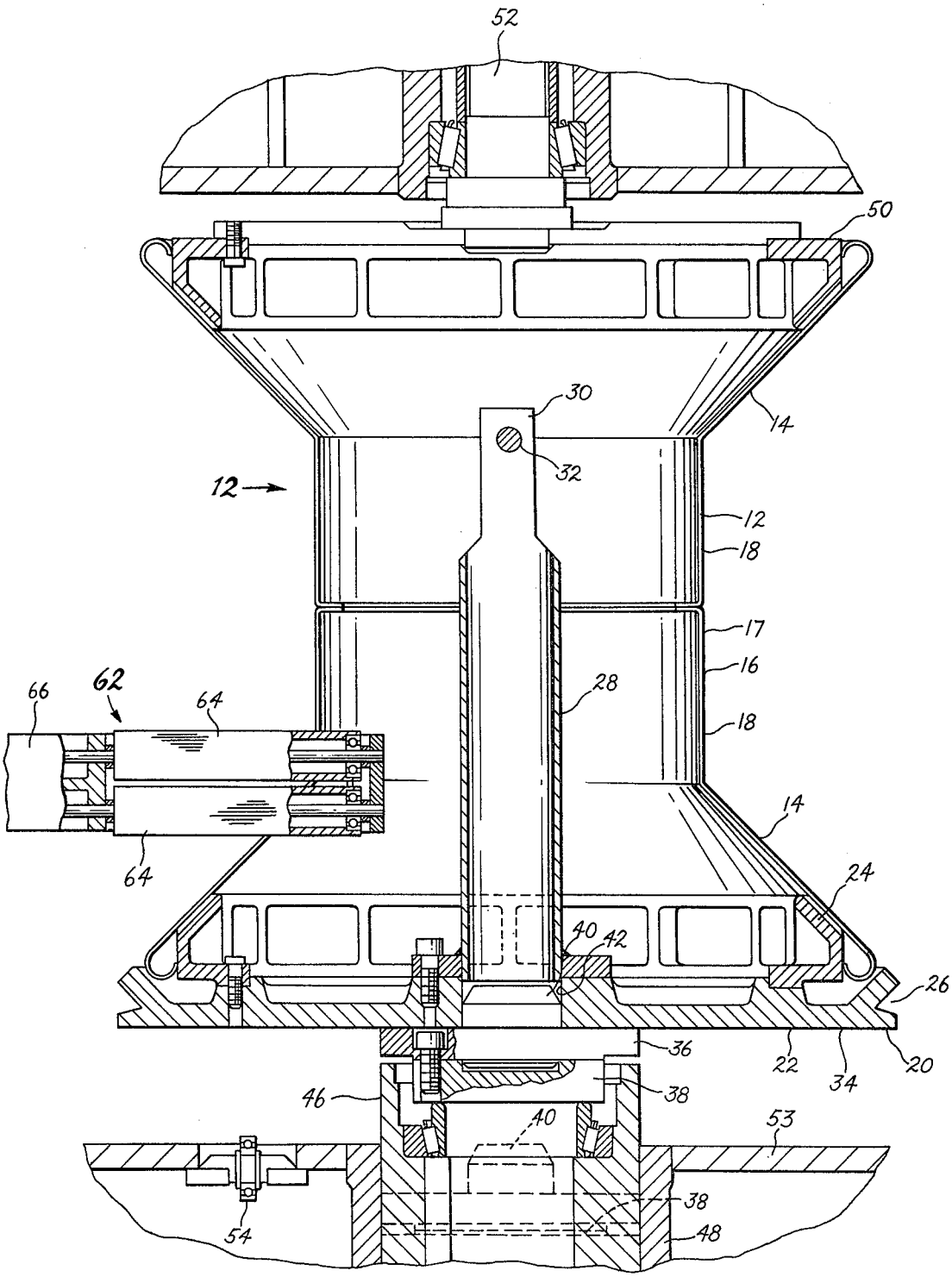
FIG. 2 is an enlarged view of a portion of the spooler as shown in FIG. 1, but in vertical section rather than in elevation.

FIGS. 1 and 2 show the spool 12 held by the spooler 10 in a winding position. In this position, the base 22 is supported by a lifting collar 36 which is part of a spindle 38 rotatable about a vertical axis, the spindle also including a pilot 40 which fits in a corresponding pilot hole 42 in the base plate 22 to center the spool relative to the spindle axis. The spindle is movable between a lowered position, shown by the broken lines of FIG. 2, and a raised position, shown by the full lines of FIG. 2, by an hydraulic cylinder 44 shown in FIG. 1, the spindle 38 being rotatably supported by a sleeve 46 raised and lowered by the cylinder 44 and slidably supported for vertical movement by a surrounding cylinder 48.

In the illustrated position of FIG. 2, the lifting collar 36 urges the spool upwardly into engagement with a driving nose ring 50 which is part of the spooler and which fits into and engages the inside surface of the upper spool flange 14. The nose ring 50 is in turn carried by a drive shaft 52 having its vertical axis of rotation aligned with the axis of the spindle 38.

In addition to the parts of the spooler described above, it also includes a frame 51 which is essentially a weldment of steel plates. One such plate is a horizontal one 53 located below the spool 12, and this plate may be provided with a number of rolls, such as the one shown at 54, which when the spool is lowered, are engageable with the bottom surface 34 of the spool base 20 and are useful as aids to loading and unloading a spool into and from the machine.

In a winding operation, the spool 12 is rotated about its vertical central axis by rotation of the drive shaft 52 which is driven at a selected speed by a variable speed motor 54 through three drive belts 56 passing over a pulley 58 fixed to the motor drive shaft and a pulley 60 fixed to the drive shaft 52.

In accordance with the invention, the spooler 10 includes a traversing guide 62 which is movable back and forth parallel to the vertical central axis of the spool to guide the wire in such a manner as to load it onto the spool in a neat and orderly fashion. The traversing guide 62 may take various different forms without departing from the invention, but in the illustrated case includes two rollers 64, 64 between which the wire (not shown) being wound passes from a supply to the spool. It will be observed that, due to the shape of the spool 12, the traversing guide 62 at the beginning of the winding need only travel the length of the cylindrical spool portion 16, but as the spool fills with wire its stroke must be increased to accommodate the extra spool length arising from the tapered shape of the flanges 14, 14 and, therefore, in further accordance with the invention a means is provided for automatically increasing the stroke of the traversing guide as the winding progresses.

Considering the mechanism for moving the traversing guide 62, the rolls 64, 64 of the guide are carried by an arm 66 fixed to a housing 68 carrying a ball nut threadably engaging the threaded portion of a screw shaft 70 so that as the shaft 70 is rotated in one direction or the other the housing 68 and the attached traversing guide 62 are moved vertically in one direction or the other parallel to the central axis of the spool. At its upper end, the screw shaft 70 includes a splined portion 72 which slidably fits within a splined socket sleeve 74 supported for rotation by a bearing 76. At its lower end the screw shaft 70 is rotatably supported by a cylindrical sleeve 78, which is guided for vertical movement by a linear bearing 80. The lower end of the sleeve 78 is in turn attached to the rod of an hydraulic cylinder 82. During the major portion of a winding operation the rod of the cylinder 82 is extended to hold the sleeve 78 and screw shaft 70 in the positions illustrated by the full lines of FIG. 1. However, at the start of winding an empty spool it is desirable to first wind some length of wire into the circumferential groove 26 of the spool base 20 to provide access to the starting portion of the wire after the spool is completely filled. For this reason, therefore, at the start of winding an empty spool, the rod of the cylinder 82 may be retracted to lower the sleeve 78 and the screw shaft 70, as indicated by the broken lines in FIG. 1, to bring the traversing guide 62 into alignment with the groove 26 and to, therefore, guide wire into such groove.

The screw shaft 70 is drivingly connected with the spool drive shaft 52 by a drive train so as to be driven at a rotational speed directly related to that of the spool. This drive train includes a clutch/braked device 84 having the spool drive shaft 52 in its input and having an output shaft 86. The clutch/brake 84 is a standard electrically operated unit having an engaged mode, in which the spool drive shaft 52 is drivingly connected with the output shaft 86, and a disengaged mode in which the shaft 52 is disengaged from the output shaft 86 and the output shaft 86 is held stationary, by the brake portion of the mechanism 84, relative to the frame 51. The output shaft 86 of the clutch/brake 84 is in turn connected to the input shaft 88 of a geared reversing mechanism 90 through a drive belt 91 trained over pulleys fixed to the shaft 86 and the shaft 88. The reversing mechanism 90 has an output shaft 93 connected to the spline socket 74 which rotatably drives the screw shaft 70. It is of standard construction and operates in response to forward (FWD) and reverse (REV) electrical signals supplied thereto from a switch circuit 92. That is, in response to a FWD signal the reversing mechanism 90 is set to rotate the output shaft 93 in the same direction as the input shaft 88, and in response to the REV signal the mechanism is set to rotate its output shaft 93 in a direction opposite to that of the input shaft 88.

Associated with the input shaft 88 of te reversing mechanism 90 is a pulse generator 94 which produces a series of time-spaced pulses 96, 96 each representing a given amount of angular movement of the shaft 88. Therefore, when the clutch/brake mechanism 84 is engaged, the pulses 96, 96 each also represent a given amount of angular rotation of the spool 12 about its central axis. For example, the arrangement may be such that two pulses 96, 96 are produced for each revolution of the spool 12 about its central axis.

The pulses 96, 96 produced by the pulse generator 94 are fed to a unit 98 which includes a first counter for counting the pulses 96, a means for storing a reference number and a comparator for comparing the count of the counter with the reference number and for producing an output signal and for resetting the counter when the count of the counter compares with the reference number.

The counter of the illustrated unit 98 is a three digit decimal counter and its count is indicated by a three digit readout 100. The reference number ($N_X$) stored in the device 98 is shown by another three digit readout 102 and may be manually initially set to any desired value by a manually operable knob 104. When the count displayed by the readout 100 compares with the reference number displayed by the readout 102, a signal in the form of a pulse is supplied to the output line 106 and the counter is reset to zero or some other initial value. The output pulse which appears on the output line 106 each time the count of the counter in the unit 98 compares with the reference number ($N_X$) is supplied by the line 108 to the switch circuit 92 which operates in response to each of such pulses to switch its output from the previously existing FWD or REV signal to the alternate signal thereby, in turn, reversing the rotation of the output shaft 93 of the reversing mechanism. In other words, each time the count of the counter in the unit 98 reaches comparison with the reference number ($N_X$) stored in the unit, the direction of rotation of the screw shaft 70 is reversed to likewise reverse the direction of travel of the traversing guide 62. Thus, the value of the reference number ($N_X$) stored in the unit 98 and shown by the readout 102 will determine the length of the stroke of the traversing guide 62, that is, it determines the end limits of the traversing guide's travel.

To achieve a lengthening of the stroke of the traversing guide 62 as the spool 12 fills with wire, the reference number ($N_X$) stored in the unit 98 is increased as the winding of the spool progresses. This is accomplished by feeding the output or comparison pulses which appear on the output line 106 also to a second unit 110. The unit 110 includes a second counter for counting the pulses appearing on the line 106 and has a two digit decimal readout 112 for displaying such count. It also includes a means for storing a two digit decimal reference number ($N_B$), displayed by the readout 114, which may be set to any desired value by a manually adjustable knob 116. When the count of the counter in the unit 110, as displayed by the readout 112, reaches the value of the stored reference number ($N_B$), displayed by the readout 114, the counter in the unit 110 is reset to zero or some other initial value and an output is supplied to the first unit 98 over the output line 118 and through a scaling converter 120. The output signal which appears on the line 118 is in the nature of a pulse and in response to it the scaling converter 120 operates to produce a number ($N_A$) which is added to the reference number ($N_X$) stored in the unit 98 and displayed by the readout 112. This number ($N_A$) may be one or any other number such as 2, 3, 4, etc., its value, as shown by the readout 122, being selectable by a manually operable knob 124.

Having now described the construction of the spooler 10 its operation may be explained as follows. After an empty spool is loaded into the spooler, to the position shown in FIG. 1, the clutch/brake mechanism 84 is disengaged and the rod of the hydraulic cylinder 82 is retracted to lower the screw shaft 70 and bring the traversing guide 62 into alignment with the groove 26 in the base 20 of the spool. The motor 54 is then energized briefly to rotate the spool 12 and wind a number of turns of wire into the groove 26. The motor is then stopped and the rod of the cylinder 82 is extended to raise the screw shaft 70 and the traversing guide 62 to the position shown by the full lines in FIG. 1. The clutch/brake mechanism 84 is then engaged and the motor 54 energized to start the winding of wire onto the cylindrical portion 16 of the spool.

For the remainder of the description it will be assumed that the pulse generator 94 produces two pulses for each revolution of the spool 12, that the reference number ($N_X$) initially stored in the unit 98 and shown by the readout 102 is 106, that the reference number ($N_B$) stored by the unit 110 and shown by the readout 114 is 02 and that the number ($N_A$) by which the reference number ($N_X$) is augmented is 1.

As the winding progresses from the position shown in FIG. 1, the traversing guide 62 moves upwardly and two pulses per revolution of the spool are supplied to the counter of the unit 98. After 53 revolutions of the spool the count of the counter in the unit 98 reaches 106 and thus compares with the reference number ($N_X$). If the reference number is properly selected, the traversing guide 62 will also at this time be aligned with the upper end of the cylindrical spool section 16. When the comparison occurs, the counter in the unit 98 is reset and a pulse is transmitted to the unit 110 to advance its counter by 1. This pulse also, through the switch 92 and reversing mechanism 90, reverses the direction of rotation of the screw shaft 70 to reverse the motion of the traversing guide causing it now to move downwardly as the spool 12 continues to rotate. When the spool completes another 53 revolutions the counter of the unit 98 again reaches comparison with its reference number and again a pulse is produced on the line 106 to reverse the direction of the traversing guide and to increment the counter of the unit 110 by one. The count of this counter is now 02 which compares with the reference number ($N_B$) stored therein and displayed by the readout 114. This causes the counter of the unit 110 to reset and produces an output pulse on the line 118 which, through the converter 120, advances the reference number ($N_X$) of the unit 98 from 106 to 107. Therefore, in the next stroke of the traversing guide 64 the spool 12 will have to rotate 53½ revolutions before the traversing guide motion is reversed, thereby causing the stroke to be slightly increased. This process continues with the stroke of the traversing guide being increased after every two strokes until the winding process is completed. Obviously, changes may be made in the number of pulses 96, 96 produced per revolution of the spool, in the initial setting of the first reference number ($N_X$), in the second reference number ($N_B$), and in the number ($N_A$) by which the first reference number ($N_X$) is augumented to suit different shapes of spools and different sizes of wire.

I claim:

1. An apparatus for winding wire onto spools, said apparatus comprising: means for rotating a spool such as aforesaid about its central axis, a traversing guide for guiding wire onto the spool rotated by said rotating means, means supporting said traversing guide for traversing movement relative to said spool back and forth along a path parallel to said central spool axis, means for moving said traversing guide along said path at a speed related to the rotational speed of said spool by a fixed speed ratio, and means for reversing the direction of said traversing guide along said path when said traversing guide reaches either one of two end limits spaced from one another along said path and between which said traversing guide moves, said reversing means including a pulse generator connected to said spool rotating means and an associated pulse counter for providing pulse counts representative of amounts of rotation of said spool, means for effecting reversal of said traversing guide when the pulse count of said counter reaches a predetermined number and means responsive to the pulse counts provided by said pulse counter for increasing said predetermined number and for thereby increasing the spacing between said two end limits as the total rotation of said spool increases during the winding of wire onto it.

2. An apparatus for winding wire onto spools, said apparatus comprising: means for rotating a spool such as aforesaid about its central axis, a traversing guide for guiding wire onto the spool rotated by said rotating means, means supporting said traversing guide for traversing movement relative to said spool back and forth along a path parallel to said central spool axis, means for moving said traversing guide along said path at a speed directly related to the rotational speed of said spool, means connected with said spool rotating means for producing in response to rotation of said spool a series of time-spaced signals each representing a given amount of rotational movement of s aid spool, means for reversing the direction of movement of said traversing guide along said path at the end of each occurrence of a controlling number ($N_X$) of said signals, and means for increasing said controlling number ($N_X$) in response to increases in the number of reversals of the direction of movement of said traversing guide during the winding of wire onto said spool.

3. An apparatus as defined in claim 2 further characterized by said means for increasing said controlling number ($N_X$) comprising means for augmenting said controlling number ($N_X$) by a given number ($N_A$) in response to each occurrence of a given number ($N_B$) of reversals in the direction of movement of said traversing guide.

4. An apparatus as defined in claim 3 further characterized by means for manually preselecting the initial value of said controlling number ($N_X$).

5. An apparatus as defined in claim 3 further characterized by means for manually preselecting said given number ($N_A$).

6. An apparatus as defined in claim 3 further characterized by means for manually preselecting said given number ($N_B$).

7. An apparatus for winding wire onto spools, said apparatus comprising: means for rotating a spool such as aforesaid about its central aixs, a traversing guide for guide wire onto the spool rotated by said rotating means, means supporting said traversing guide for traversing movement relative to said spool back and forth along a path parallel to said central spool axis, means for moving said traversing guide along said path at a speed directly related to the rotational speed of said spool, a pulse generator associated with said spool rotating means for generating electrical pulses each of which represents a given amount of rotational movement of said spool, a first counter for counting said pulses, a device storing a first reference number, means for reversing the direction of movement of said traversing guide along said path each time the count of said first counter reaches said first reference number and for simultaneously resetting said first counter to a given initial value, and means for augmenting said first reference number by a given number ($N_A$) in response to each given number ($N_B$) of reversals of the direction of movement of said traversing guide.

8. An apparatus as defined in claim 7, further characterized by said means for augmenting said reference number being a second counter for counting the resettings of said first counter, a device for storing a second reference number, and means for augmenting said first reference number by said given number ($N_A$) each time the count of said second counter reaches said second reference number and for simultaneously resetting said second counter to a given initial value.

9. An apparatus as defined in claim 8 further characterized by means for manually preselecting the initial value of said first reference number.

10. An apparatus as defined in claim 8 further characterized by means for manually preselecting said given number ($N_A$).

11. An apparatus as defined in claim 8 further characterized by means for manually preselecting said given number ($N_B$).

12. An apparatus for winding wire onto spools of the type having two end flanges at least one of which is tapered, a cylindrical portion of uniform diameter between said two end flanges, and a circumferential groove located at the outboard end of said at least one tapered end flange, said apparatus comprising: means for rotating a spool such as aforesaid about its central axis, a traversing guide for guiding wire onto the spool rotated by said rotating means, means supporting said traversing guide for traversing movement relative to said spool back and forth along a path parallel to said central spool axis, means for aligning said traversing guide with said circumferential groove at the start of winding wire onto said spool so as to initially wind a starting length of wire onto said groove, means for thereafter moving said traversing guide into alignment with that end of said cylindrical portion of said spool which is adjacent said groove, means for thereafter moving said traversing guide along said path at a speed directly related to the rotational speed of said spool and initially in the direction toward the opposite end of said cylindrical portion of said spool, means for reversing the direction of said traversing guide along said path when said traversing guide reaches either one of two end limits spaced from one another along said path and between which said traversing guide moves, and means connected with said spool rotating means for increasing the spacing between said two end limits in response to increases in the total rotation of said spool during the winding of wire onto it.

13. An apparatus as defined in claim 12 further characterized by said means supporting said traversing guide for traversing movement relative to said spool and said means for moving said traversing guide at a speed directly related to the rotational speed of said spool including a traversing guide shaft extending parallel to the central axis of said spool, means for rotating said shaft about its longitudinal axis at a speed directly related to the speed of rotation of said spool, and a coupling means carried by said shaft and connected to said traversing guide for moving said guide longitudinally of said shaft in response to rotation of said shaft, and said means for aligning said traversing guide with said circumferential groove at the start of winding wire onto said spool and said means for thereafter moving said traversing guide into alignment with the adjacent end of said cylindrical portion of said spool comprising a means for shifting said shaft linearly along its longitudinal axis between two different positions.

14. An apparatus as defined in claim 13 further characterized by said shaft being a screw shaft and said coupling means being a nut means threadably engageable with said screw shaft.

15. An apparatus as defined in claim 13 further characterized by said means for rotating said spool including a drive shaft drivingly connected with said spool, a drive motor drivingly connected with said spool drive shaft, a drive train between said spool drive shaft and said traversing guide shaft, said drive train including a clutch mechanism having an engaged condition in which motion is transmitted therethrough from said spool drive shaft to said traversing guide shaft to cause said traversing guide to be moved at a speed directly related to the rotational speed of said spool and also having a disengaged condition in which no motion is transmitted from said spool drive shaft to said traversing guide shaft.

16. An apparatus as defined in claim 15 further characterized by a brake mechanism associated with said clutch mechanism for holding said traversing guide shaft stationary when said clutch mechanism is disengaged.

17. An apparatus as defined in claim 13 further characterized by said means for reversing the direction of movement of said traversing guide along said path including a reversing mechanism in said drive train, said reversing mechanism having an input shaft, an output shaft and for a given direction of rotation of said input shaft being operable to rotate said output shaft in one or the other direction in response respectively to forward and reverse signals supplied thereto, and switching means for supplying one of such forward and reverse signals to said reversing means and for switching to the other one of such signals each time said traversing guide reaches one of said end limits.

18. An apparatus for winding wire onto spools, said apparatus comprising: means for rotating a spool such as aforesaid about its central axis, a traversing guide for guiding wire onto the spool rotated by said rotating means, a screw shaft extending parallel to said central axis of said spool, a nut means carried by said screw shaft and connected with said traversing guide for moving said traversing guide parallel to said central axis of said spool in response to rotation of said screw shaft, said means for rotating said spool including a spool drive shaft drivingly connected with said spool, a drive motor drivingly connected with said spool drive shaft, a drive train between said spool drive shaft and said screw shaft, said drive train including a clutch mechanism having an engaged condition in which motion is transmitted therethrough from said spool drive shaft to said screw shaft to cause said traversing guide to be moved at a speed directly related to the rotational speed of said spool and also having a disengaged condition in which no motion is transmitted from said spool drive shaft to said screw shaft, said drive train also including a reversing mechanism operable to cause rotation of said screw shaft in one or the other direction in response respectively to a forward or a reverse signal supplied thereto, a pulse generator associated with said screw shaft for generating electrical pulses each of which represents a given amount of rotational movement of said screw shaft, a device for storing a first reference number, a first counter for counting said pulses, switching means coupled with said first counter and with said reversing mechanism and for switching to the other of such signals each time said count of said first counter reaches said first reference number and for simultaneously resetting said first counter to a given initial value, a second counter for counting the resettings of said counter, a device for storing a second reference number, and means for augmenting said first reference number by a given number ($N_A$) each time the count of said second counter reaches said second reference number and for simultaneously resetting said second counter to a given initial value.

19. An apparatus as defined in claim 18 further characterized by means for shifting said screw shaft linearly along its longitudinal axis between two different positions.

20. An apparatus for winding wire onto spools, said apparatus comprising: means for rotating a spool such as aforesaid about its central axis, said means including a spool drive shaft drivingly connectable with said spool, a drive motor drivingly connected with said spool drive shaft, a traversing guide for guiding wire onto said spool, a screw shaft arranged parallel with said central axis of said spool, a nut fixed to said traversing guide, said nut being carried by said screw shaft and threadably connected therewith so as to move said traversing guide parallel to said central axis of said spool in response to rotation of said screw shaft, a drive train including a clutch having engaged and disengaged conditions connected between said spool drive shaft and said screw shaft for rotating said screw shaft at a speed directly related to the speed of rotation of said spool drive shaft when said clutch is in its engaged condition, said drive train also including a reversing mechanism operable in either a forward or a reverse mode to reverse the direction of rotation of said screw shaft, means associated with said screw shaft for producing in response to rotation of said screw shaft a series of time-spaced signals each representing a given amount of rotation of said screw shaft, means for switching the mode of said reversing mechanism at the end of each occurrence of a controlling number ($N_X$) of said signals, and means for increasing said controlling number ($N_X$) in response to increases in the number of reversals of said reversing means during the winding wire onto said spool.

* * * * *